US007674971B2

(12) United States Patent
Saunders

(10) Patent No.: US 7,674,971 B2
(45) Date of Patent: Mar. 9, 2010

(54) KEYBOARD ATTACHMENT FOR DISABLED PERSONS

(76) Inventor: Craig Saunders, 167 Central Ave., North Versailles, PA (US) 15137

( * ) Notice: Subject to any disclaimer, the term of this patent is extended or adjusted under 35 U.S.C. 154(b) by 1099 days.

(21) Appl. No.: 11/301,289

(22) Filed: Dec. 12, 2005

(65) Prior Publication Data

US 2006/0169127 A1 Aug. 3, 2006

Related U.S. Application Data

(63) Continuation-in-part of application No. 10/721,734, filed on Nov. 25, 2003, now Pat. No. 6,974,903.

(51) Int. Cl.
*G10H 1/32* (2006.01)

(52) U.S. Cl. ..... 84/744; 400/472

(58) Field of Classification Search ..... 84/744, 84/719, 425, 453, 686; 341/21, 22; 400/489, 400/472, 93

See application file for complete search history.

(56) References Cited

U.S. PATENT DOCUMENTS

| | | | | |
|---|---|---|---|---|
| 3,135,034 | A * | 6/1964 | Fauteux | 24/506 |
| 4,513,652 | A | 4/1985 | Muramatsu et al. | |
| 4,729,276 | A * | 3/1988 | Cutler | 84/425 |
| 5,025,705 | A | 6/1991 | Raskin | |
| 5,339,213 | A | 8/1994 | O'Callaghan | |
| 5,391,006 | A * | 2/1995 | Danziger | 400/488 |
| 5,493,075 | A | 2/1996 | Chong et al. | |
| D390,211 | S | 2/1998 | Yates et al. | |
| 5,753,840 | A | 5/1998 | Saboia | |
| 5,856,022 | A | 1/1999 | McCormick | |
| 5,856,822 | A | 1/1999 | Du | |
| 5,909,211 | A | 6/1999 | Combs | |
| 5,956,019 | A | 9/1999 | Bang | |
| 6,060,653 | A | 5/2000 | Willis | |
| 6,107,997 | A | 8/2000 | Ure | |
| 6,226,050 | B1 | 5/2001 | Lee | |
| 6,271,452 | B1 | 8/2001 | Bernard | |
| 6,284,961 | B1 | 9/2001 | Kimmel, Jr. | |
| D449,307 | S | 10/2001 | Amano et al. | |
| 6,323,845 | B1 | 11/2001 | Robbins | |
| 6,329,585 | B1 | 12/2001 | Chono | |
| 6,336,614 | B1 | 1/2002 | Kwitek | |
| 6,388,660 | B1 | 5/2002 | Manser | |
| 6,644,605 | B1 | 11/2003 | Tyner | |
| 6,974,903 | B2 * | 12/2005 | Saunders | 84/744 |
| 7,182,533 | B1 * | 2/2007 | Caplan | 400/489 |
| 2002/0050206 | A1 | 5/2002 | MacCutcheon | |
| 2005/0129447 | A1 | 6/2005 | Benson | |

* cited by examiner

*Primary Examiner*—Elvin G Enad
*Assistant Examiner*—Jianchun Qin
(74) *Attorney, Agent, or Firm*—The Webb Law Firm

(57) ABSTRACT

A key extender includes an elongated member, e.g., a deformable metal rod, having a first end portion secured to a contact member, e.g., a circular disc having a contact area greater than the available touch plate surface area of the key. An opposite second end portion of the elongated member is secured to a first part of a fastening arrangement, with the other part of the fastening arrangement on a key of a keyboard. Mounting an extender on each of the keys of a keyboard and shaping the metal rod to position the discs adjacent to and spaced from one another allows a disabled person to depress the closely adjacent keys of the keyboard, e.g. and not limited to, the keys of a piano or keys of a typewriter.

13 Claims, 5 Drawing Sheets

KEYBOARD ATTACHMENT FOR DISABLED PERSONS

CROSS-REFERENCE TO RELATED APPLICATION

This application is a continuation-in-part of U.S. patent application Ser. No. 10/721,734, filed Nov. 25, 2003, in the name of Craig Saunders for "Keyboard Attachment For Disabled Persons", now U.S. Pat. No. 6,974,903. Disclosure Document No. 526012 deposited on Feb. 13, 2003 by Craig Saunders for Keyboard Attachments is related to the subject matter of this application and is hereby incorporated by reference.

BACKGROUND OF THE INVENTION

1. Field of the Invention

This invention relates to an attachment to a key of a keyboard for disabled persons and, more particularly, to attachments for keys of a keyboard to provide a contact area greater than the available touch plate surface area of the keys.

2. Description of Related Art

The keys of keyboards for musical instruments, e.g., pianos and organs, and for equipment, e.g., typewriters, calculators, telephones, machine consoles, and computers, are closely spaced to one another and systematically arranged to play a musical arrangement or to operate a machine or device, respectively. The keys are closely spaced to facilitate rapid displacement of the fingers of the player or operator over selected keys and systematically depressing the selected keys.

Although the closely spaced keys facilitate contact for the able person, they pose drawbacks for the disabled person, e.g., a person with missing fingers, hand(s), arthritic hands and/or fingers, to name a few limitations. One solution is to enlarge the touch plate surface area of the keys. This solution has drawbacks, e.g., increased cost of making a larger keyboard for a low volume product, and requiring increased floor area to support the musical instrument and increased surface area to support the-keyboard for equipment.

As can be appreciated, it would be advantageous to provide an attachment to the keys that eliminates the above drawbacks, e.g., makes the size of the keys of the presently available keyboards of musical instruments and equipment useable by disabled persons.

SUMMARY OF THE INVENTION

This invention relates to an attachment or extender for a key of a keyboard, the key having a predetermined available touch plate surface area. The term "available touch plate surface area" is defined herein. The extender includes an elongated member or rod having a first end portion secured to a contact member, and an opposite second end portion secured to an attachment member to be attached to the keys of the keyboard. In one non-limiting embodiment of the invention, the contact surface area of the contact member is greater than the predetermined available touch plate surface area of the key. In another non-limiting embodiment of the invention, with the attachment member of a plurality of extenders connected to the keys of a keyboard, the spaced distance between adjacent contact members is greater than the spaced distance between the keys of the keyboard. Displacing the contact member of an extender attached to a key in a predetermined direction, e.g., downward direction, displaces the key in the downward direction. The keyboard is selected from at least one of the following: a musical instrument keyboard, a computer keyboard, a calculator keyboard, a typewriter keyboard, a machine console keyboard, and a telephone keyboard. In the discussion of non-limiting embodiments of the invention, the keyboard is a piano keyboard.

In other non-limiting embodiments of the invention, the elongated member has a first end portion secured to a contact member and an opposite second end portion having one part of a fastening arrangement, e.g., one part of a Velcro® fastener, and a key of the keyboard having another part of the fastening arrangement, e.g., the other part of the Velcro® fastener. With the parts of the fastening arrangement joined together, the second end portion of the fastener is secured to the key, and displacing the contact member in a predetermined direction displaces the key in the predetermined direction.

Still further, the invention relates to a method of depressing two or more keys of a keyboard. The method includes, among other things, the steps of providing at least two key extenders, the key extenders including a deformable rod having a first end portion secured to a contact member. The rod is shaped such that upon attaching it to its respective key, the contact members are adjacent to and spaced from one another. A user selectively depresses one of the contact members to depress a corresponding key.

Having the contact area of the contact member greater than the available touch plate surface area of the key and/or having adjacent contact members of extenders connected to adjacent keys of a keyboard spaced a greater distance from one another than the spaced distance between the adjacent keys, e.g., adjacent white keys of a piano keyboard, allows a disabled person to depress a key by depressing the contact member, thereby avoiding depressing or contacting adjacent keys.

DETAILED DESCRIPTION OF THE PREFERRED EMBODIMENTS

Figure 1:
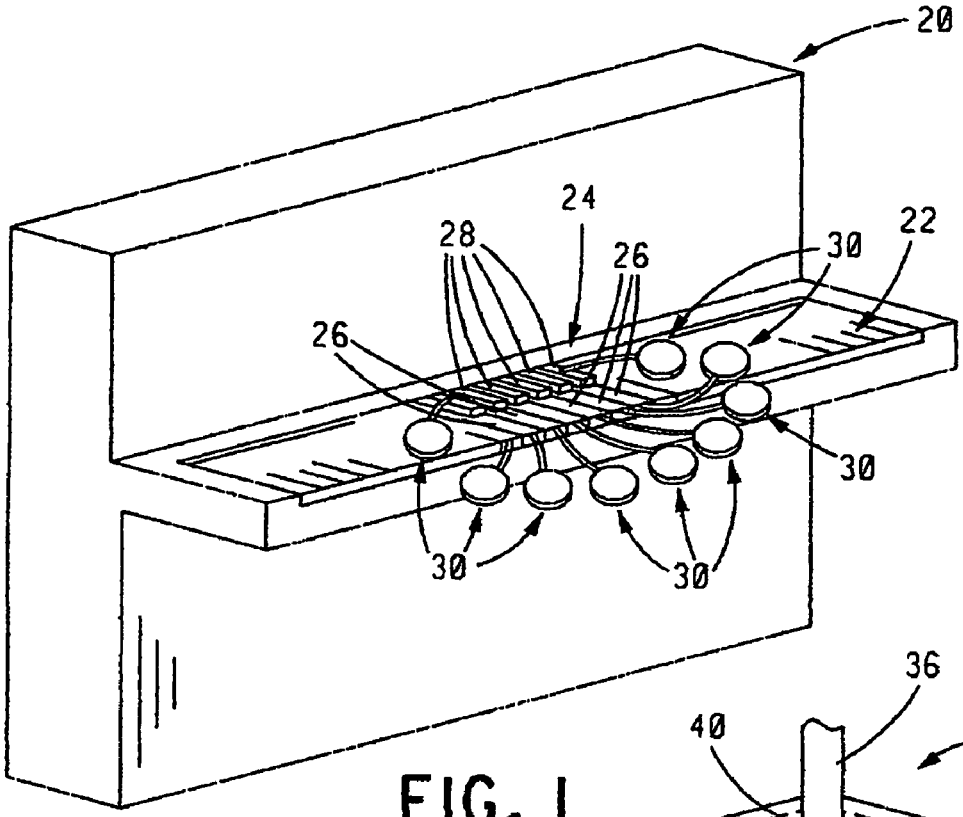
FIG. 1 is an orthogonal view of an upright piano showing only keys for one octave and having extenders according to the invention attached to selected white and black keys of the piano keyboard.

The invention will be described for use with keys of a musical keyboard and, in particular, with the keys of a piano keyboard. As will be appreciated, the invention is not limited thereto and can be used with the keyboard of other musical instruments, e.g. but not limiting the invention thereto, organs, and the keyboard of machines and devices, e.g. but not limiting the invention thereto, typewriters, calculators, telephones, machine consoles, and computers. Further, in the following discussion, the piano has only one keyboard; however, as will be appreciated, the invention is not limited thereto and can be practiced on pianos or organs having multi-deck keyboards.

In the following discussion and in the claims, the term "available touch plate surface area" means the area of the key provided for contact by the finger, e.g. but not limiting the invention thereto, the area of the keys of musical instruments, e.g., the black keys, and of typewriters, telephones, computer keyboards, machine console keyboards, and calculators. The "available touch plate surface area" for white piano keys is the area of the touch plate surface of white keys available for contact. The white keys of a musical keyboard have a portion of the touch plate surface in front of the black keys and a portion of the touch plate surface between the black keys. The portion of a white piano key in front of the black piano keys is the "available touch plate surface area" when referring to a white key of a musical instrument keyboard.

As used herein, spatial or directional terms, such as "inner", "outer", "left", "right", "up", "down", "horizontal", "vertical", and the like, relate to the invention as it is shown in the drawing figures. However, it is to be understood that the invention can assume various alternative orientations and, accordingly, such terms are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g., 1 to 6.3, and ending with a maximum value of 10 or less, e.g., 5.5 to 10, and all subranges in between, e.g., 2.7 or 6.1.

Before discussing non-limiting embodiments of the extenders of the invention, it is understood that the invention is not limited in its application to the details of the particular non-limiting embodiments shown and discussed herein since the invention is capable of other embodiments. Further, the terminology used herein to discuss the invention is for the purpose of description and is not of limitation. Still further, unless indicated otherwise in the following discussion, like numbers refer to like elements.

Shown in FIG. 1 is an upright piano 20 having a keyboard 22 having an assemblage or musical octave 24 of white keys 26 and black keys 28, and an attachment or extender 30 incorporating features of the invention attached to the white keys 26 and outer ones of the black keys 28 of the assemblage 24. As can be appreciated by those skilled in the art, the keyboard of a piano has more than one octave and usually has about 8½ octaves. Only one assemblage or octave is shown in FIG. 1 for ease of discussion. Therefore, the following discussion relating to the white and black keys of the assemblage 24 is applicable unless indicated otherwise to any white and/or black key of the assemblage 24 shown in FIG. 1 and the assemblages of the keyboard understood to be present and not shown in FIG. 1. Further, in FIG. 1, the extender 30 is shown attached to all of the white keys 26 and the outer black keys 28. As can be appreciated, the extender 30 can be attached to all of the white and black keys or less than all of the white and/or black keys.

Figure 2:
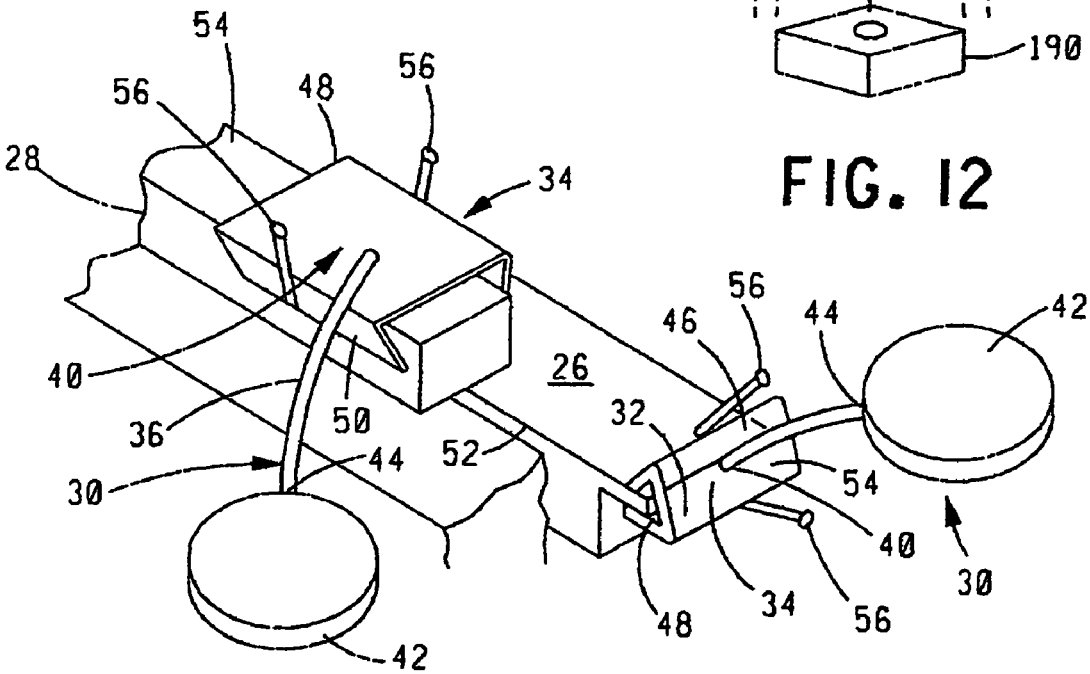
FIG. 2 is an orthogonal view of black and white keys of the piano shown in FIG. 1 having an extender according to the invention attached to each of the black and white keys.

In reference to FIG. 2, the extender 30 is shown mounted on flange 32 of the white key 26 and on the black key 28. The extender 30 includes an attachment member 34 to secure the extender 30 to the black key 28 and the flange 32 of the white key 26, and an elongated rod 36 having end portion 40 connected to the attachment member 34 in a manner discussed below. A disc 42 is connected to an opposite end portion 44 of the rod 36 in a manner discussed below.

The design of the attachment member 34 is not limiting to the invention but preferably has a design and configuration to removably engage the keys. In FIG. 2, the attachment member 34 is a clip 48 having a pair of legs 50 and 52 connected to a base 54. The base 54 and legs 50, 52 of the clip 48 are formed from one piece of spring steel and have the legs 50 and 52 biased toward one another. A lever or handle 56 mounted to the outer surface of each of the legs 50 and 52 is urged toward the other lever to increase the space between the ends of the legs 50 and 52. The clip 48 may then be positioned over the body of the keys, e.g., as shown for the black key 28, or over the flange of the key, e.g., as shown for the white key 26. The clip 48 is similar to a binder clip, e.g., of the type sold by ACCO Brands, Inc. under the registered trademark ACCO®.

As can be appreciated, the invention is not limited to the design of the attachment member 34. In the practice of the invention, it is preferred that the attachment member 34 be detachably secured to the keys 26 and 28 of the keyboard 22. In this manner, the extender 30 can be attached to the keys 26 and 28 as needed, making the piano useable by abled and disabled persons. In the following discussion, non-limiting embodiments of attachment members are present. As can be appreciated, the invention is not limited thereto and the following types of attachment members are present for purposes of illustration and not limitation.

Figure 3:
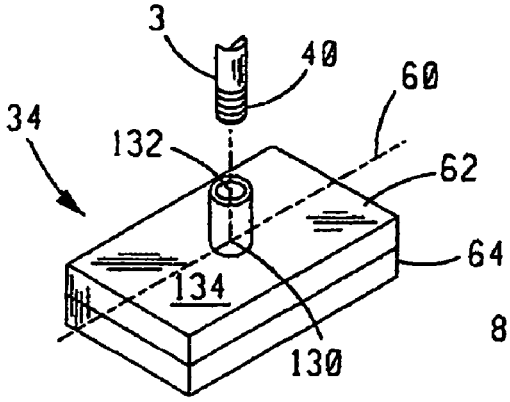
FIG. 3 is an orthogonal view of an attachment member to secure the extender to a piano key of the keyboard.

With reference to FIG. 3, the attachment member 34 is a plate arrangement designated by the number 60. The plate arrangement 60 includes a plate member 62 and a securing layer 64 to secure the plate member 62 to the keys, e.g., the contact surface area of the keys. The layer 64 may be any type of adhesive to securely bond the plate member 62 to a key, e.g. but not limiting the invention thereto, adhesives of the type sold by MACCO of Cleveland under the trademark Liquid Nails™ or to detachably secure the plate member 62 to a key, e.g. but not limiting the invention thereto, an adhesive of the type used on paper sold by 3M Corporation under the registered trademark Post-It Notes®. In another non-limiting embodiment of the invention, the layer 64 may be a suction member to secure the plate member 62 to the keys or one part of a multi-part fastening arrangement of the type discussed below.

Figure 4:
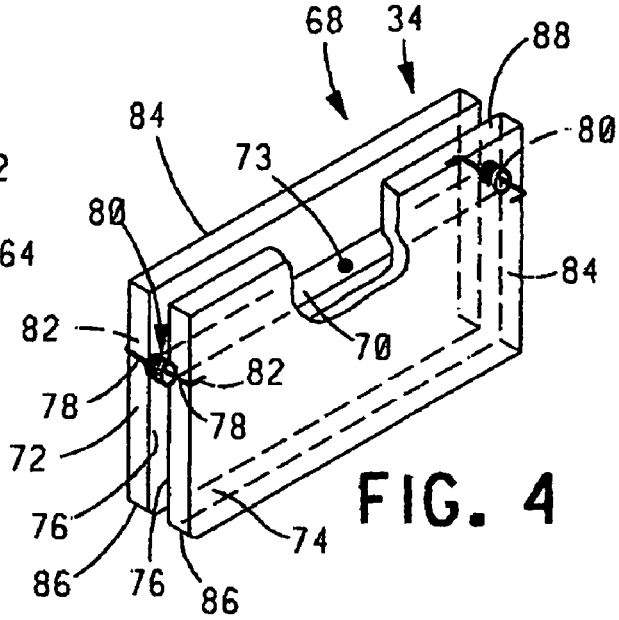
FIG. 4 is an orthogonal view of another embodiment of an attachment member of the invention to secure the extender to a piano key of the keyboard.

In a further non-limiting embodiment of the invention, the attachment member 34 shown in FIG. 4 is clip arrangement 68 having a shaft 70 between a pair of plates 72 and 74. An inside surface 76 of each of the plates 72 and 74 has a groove 78 to secure the shaft 70 in position between the plates 72 and 74, and a spring 80 mounted on opposed ends of the shaft 70. The spring 80 has extenders 82 that engage an outer surface 84 of the plates 72 and 74 and bias lower end portions 86 of the plates 72 and 74 toward one another. Urging upper end portions 88 of the plates 72 and 74 toward one another increases the distance between the lower end portions 86 of the plates 72 and 74. The plates 72 and 74 of the clip arrangement 68 can be sized to fit between the keys without causing drag on the movement of the keys. Clip arrangements 68 on adjacent keys can be offset from one another, e.g., spaced different distances from the end of the keys, to prevent overlapping of the plates 72 and 74 of adjacent clip arrangements 68. As can be appreciated, the lower end portions 86 of the plates 72 and 74 of the clip arrangement 68 can be biased away from one another by leaf springs, coil springs, or washer springs. Further, a non-limiting embodiment of the invention contemplates the use of a threaded shaft passing through the upper portion of the plates to move the lower end portions of the plates 72 and 74 toward and away from one another. An elongated member can be threadably engaged in bore 73.

Figure 5:
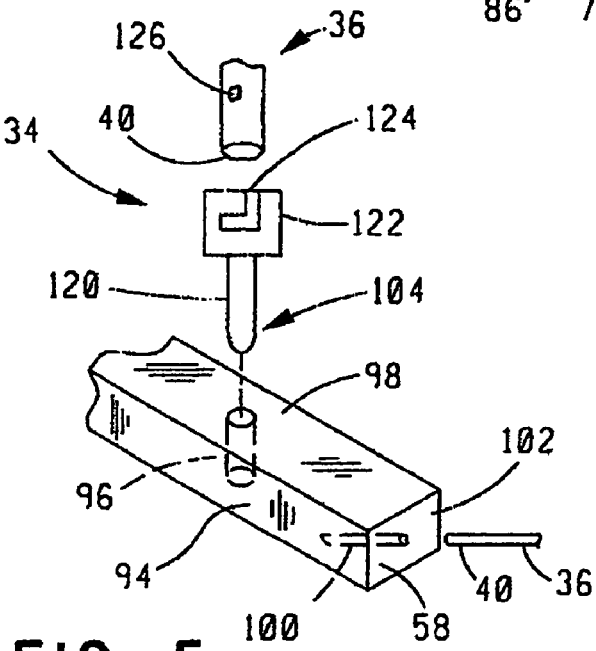
FIG. 5 is an orthogonal view of a key of a piano keyboard showing other attachment members of the invention to secure the extender to the key of the keyboard.
Figure 6:
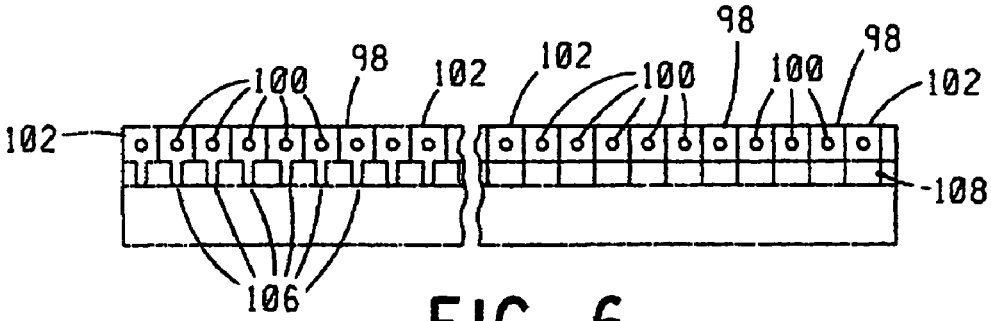
FIG. 6 is a front, elevated partial view of right and left halves of a piano frame having portions removed to depress the keys using extenders incorporating features of the invention.

With reference to FIG. 5, there is shown a still further non-limiting embodiment of attaching the end portion of the rod 36 to a piano key. Shown in FIG. 5 is key 94, which can be a black key or a white key of a musical keyboard. The key 94 has a passageway 96 starting at a touch plate surface 98 of the key 94 and extending into the body of the key and/or a passageway 100 starting at front end 102 of the key extending into the body of the key. The passageways 96 and 100 can be sized to receive insert 104, or the end portion 40 of the rod 36. In the practice of the invention, it is preferred to use the insert 104 because the internal size of the passageway in the key can usually be made smaller to receive a structurally stable insert than the end portion 40 of the rod 36. Further, in the practice of the invention, the passageway 100 preferably slopes downward to prevent the insert 104 or end portion 40 of the rod 36 from falling out of the passageway. With reference to FIG. 6, in the event the insertion of the insert 104 or end portion 40 of the elongated rod 36 into the passageway 100 in the front end 102 of the key 94 prevents the key from being depressed, grooves 106 can be cut into the front board of the piano as shown in the left portion of FIG. 6, or a portion 108 of the front board of the piano may be cut out as shown in the right portion of FIG. 6.

Figure 7:
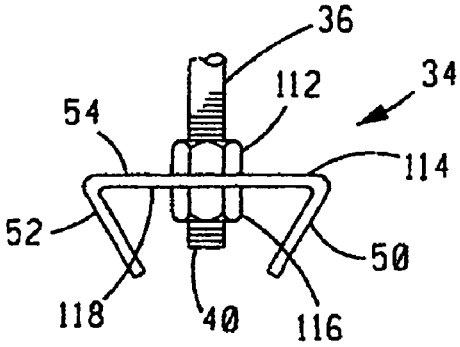
FIG. 7 is a front, elevated partial view of a clip showing the attachment of an end portion of the elongated rod of the extender to the clip.

The end portion 40 of the elongated rod 36 can be secured to the attachment member 34 in any convenient manner, e.g. but not limited to the invention, by an adhesive, flowed molten metal or metal alloy, e.g., solder or mechanical fastening, e.g., releasable securing arrangements or locking facilities. In the practice of the invention, it is preferred to connect the end portion 40 of the rod 36 to the attachment member 34 with releasable securing arrangements or locking facilities. In this manner, any one of the various types of attachment members 34 can be used to secure the extender 30 to a key of the keyboard. With reference to FIG. 7, the end portion 40 of the elongated rod 36 may have threads 110 which are threaded into and through bolt 112 on outer surface 114 and into and through bolt 116 on inner surface 118 of the base 54 of the clip 48 to secure the end of the rod 36 to the clip 48. With reference to FIG. 5, the insert 104 has a shaft 120 that is sized to fit into the passageway 96 and an open-ended collar 122 having an L-shaped groove 124 in the wall of the collar 122. The end portion 40 of the elongated rod 36 has a tab 126 that slides into the long leg of the groove 124, after which the elongated rod 36 is rotated to move the tab 126 into the short leg of the L-shaped member 124 to capture the end portion 40 of the elongated rod 36 in the collar 122.

With reference to FIG. 3, a shaft 130 having an internally-threaded end 132 is securely mounted on surface 134 of the plate 62. The end portion 40 of the elongated rod 36 has threads for detachably securing the end portion 40 of the elongated rod 36 to the end 132 of the shaft 130. Alternatively, the end portion 40 of the elongated rod 36 may be bent to form a loop, and a screw or rivet may be passed through the loop into the attachment member and/or the contact member to secure the end portion 40 of the elongated rod 36 thereto. As can be appreciated, the securing techniques discussed above are interchangeable, e.g. but not limiting to the invention, the internal walls of the passageways 96 and 100 can be threaded to receive threaded end portion 40 of the elongated rod 36, the detachable securing arrangements may be interchanged and used with any of the different attachment members, e.g., attachment members 34, 60, and 68. Further, any type of securing techniques may be used to secure or detachably secure the end portion 40 of the elongated rod 36 to the attachment member 34.

The elongated rod 36 may be made of any material that transmits force applied to one end portion of the rod to the other end portion, e.g., moving one end of the rod in a downward direction moves the body and the opposite end portion of the rod in a downward direction. In one non-limiting embodiment of the invention, the elongated rod is a preshaped rigid plastic, wooden, or metal rod. In this instance, the rod has a predetermined shape. In the practice of the invention but not limiting the invention thereto, a metal wire having tensile yield strength of about 30,000 to 50,000 pounds per square inch ("PSI") can be shaped with shaping tools or preshaped during forming. In another non-limiting embodiment of the invention, the elongated rod 36 has sufficient flexure that it can be shaped manually and maintain its shape when supported at one end and extended in a horizontal position. Although not limiting to the invention, metal wires having a yield strength between 10,000 to less than 30,000 PSI. and preferably between 15,000 to 25,000 PSI, can be used as flexible rods in the practice of the invention. As can be appreciated, as the length of the elongated wire increases, the amount of force required to bend the elongated member between its end portions decreases. The invention is not limited to the length of the elongated member; however, to provide a distance from the keyboard, the elongated member should be at least six inches in length. As can be appreciated, as the cross-sectional area of the wire increases, the force required to bend the wire between its endpoints increases, and for manually bending the elongated member or wire as the yield strength increases, the cross-sectional area preferably decreases. Therefore, in selecting the elongated rod, the length, and the cross-sectional area and the yield strength of the wire are to be considered. Another factor that is to be considered is the weight of the extender 30. The weight should not be greater than the force required to move the key to its initial position or play position after the key has been depressed. In the practice of the invention, a carbon steel coat hanger wire having a length of about 12 inches and a diameter of about 1/16 inch was used to transmit a downward force applied to the disc 42 to the key of a piano keyboard.

Figure 8A:
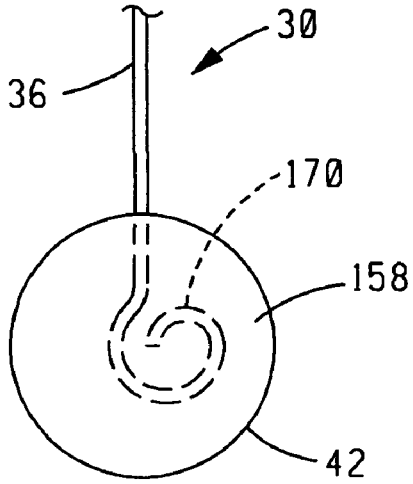
FIG. 8 is a plan view of several non-limiting embodiments of contact members that can be used in the practice of the invention.
Figure 8B:
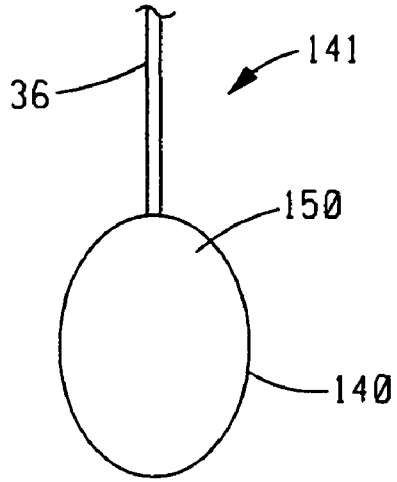
Figure 8C:
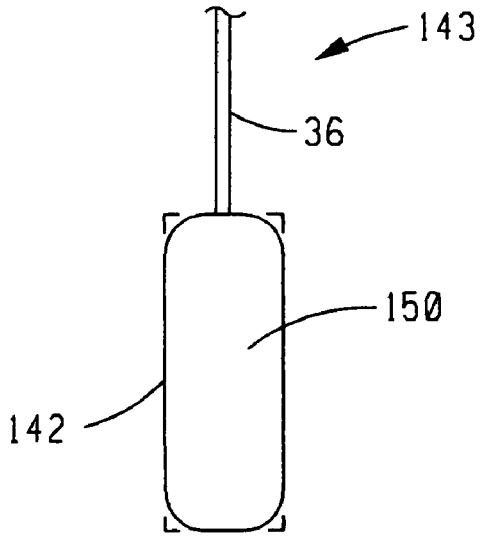
Figure 8D:
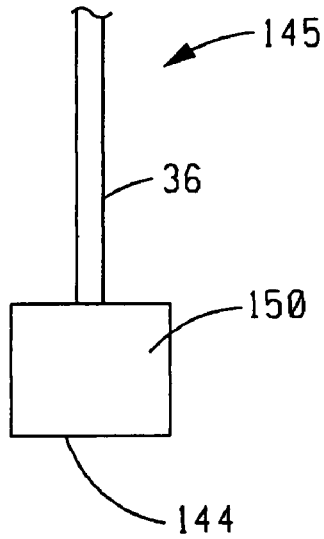
Figure 9:
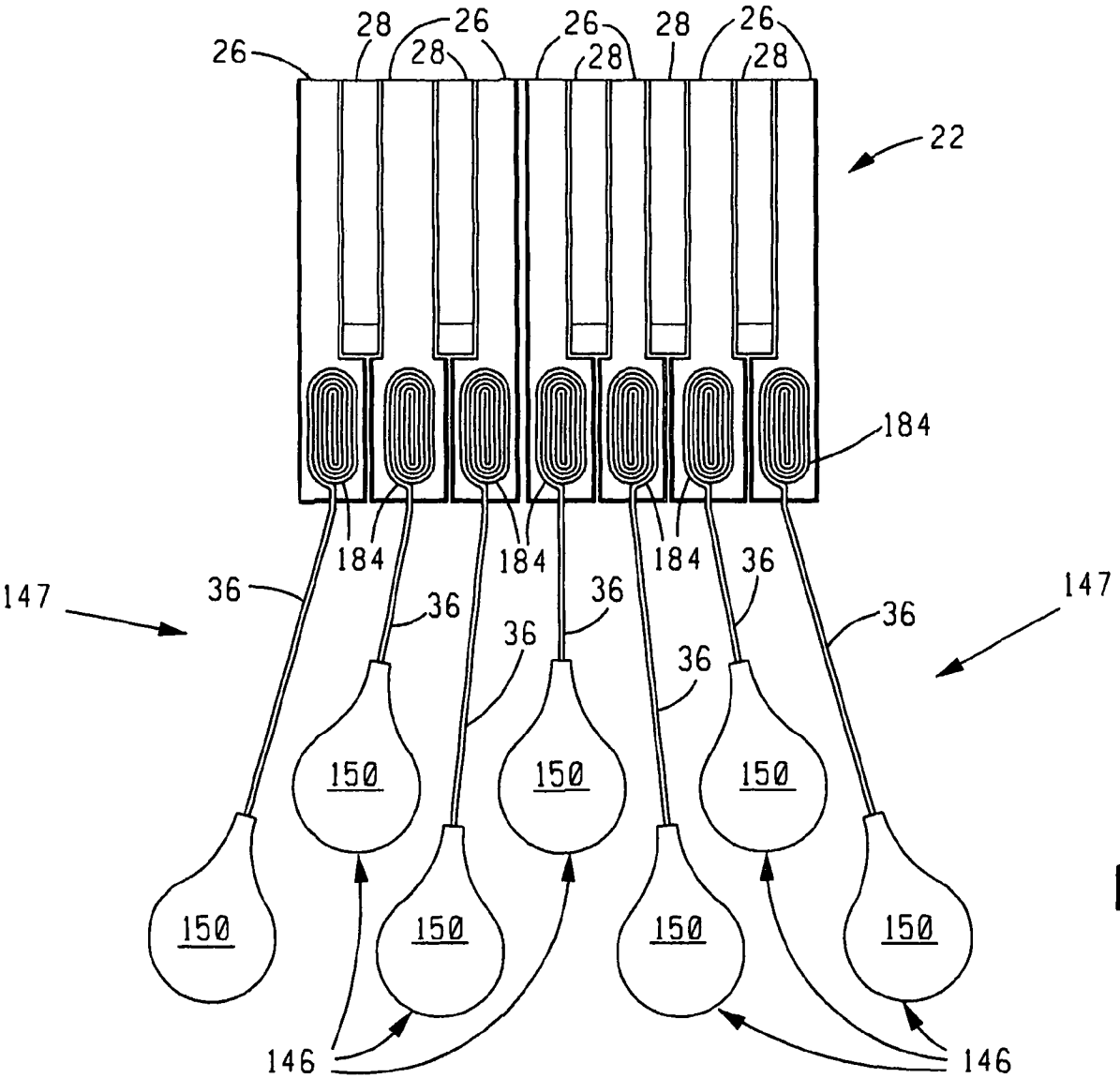
FIG. 9 is a plan view of one octave of a piano keyboard having a non-limiting embodiment of the extenders of the invention attached to the white keys.
Figure 11:
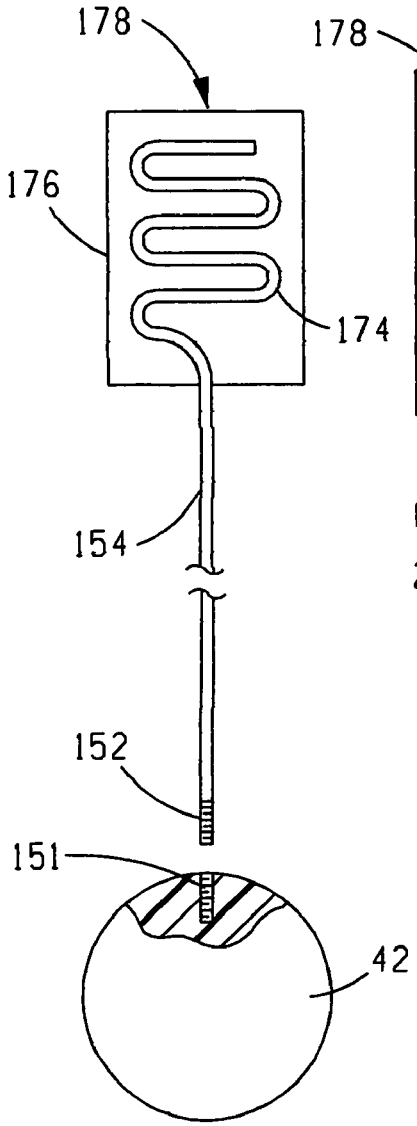
FIG. 11 is a plan view of another non-limiting embodiment of the extender of the invention having portions removed for purposes of clarity and having one part of a fastening arrangement and a partial plan view of a key of a piano keyboard having the other part of the fastening arrangement.
Figure 11:
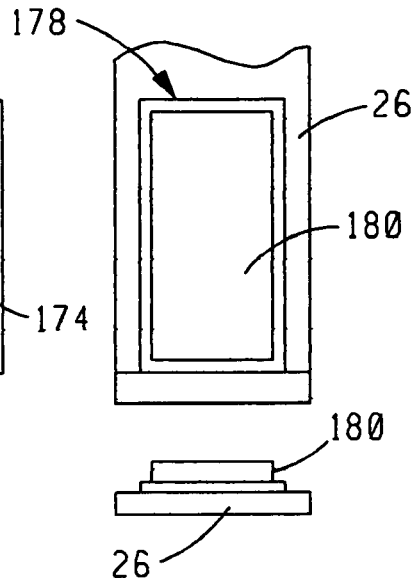
Figure 10:
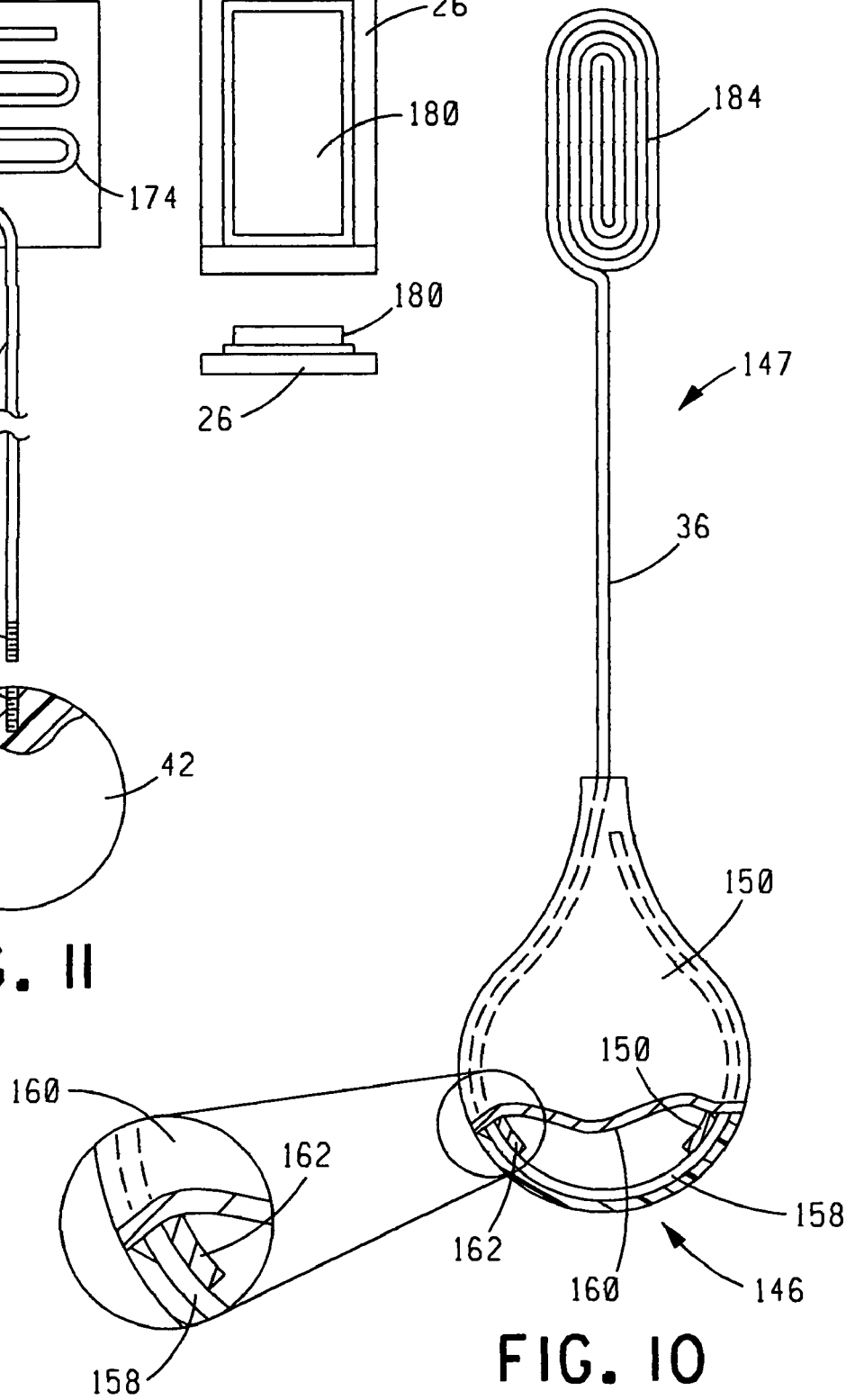
FIG. 10 is a plan view of a non-limiting embodiment of an extender of the invention having a portion removed and a portion enlarged for purposes of clarity.

The disc can be made of any rigid material having any shape, e.g. and not limiting to the invention, a circular shape as shown for the disk 42 (see FIGS. 1 and 8A), an elliptical shape as shown for disc 140 of extender 141 (see FIG. 8B), a rectangular shape having rounded corners as shown for disc 142 of extender 143 (see FIG. 8C) or square corners (as shown in phantom in FIG. 8C), a square shape as shown for disc 144 of extender 145 (see FIG. 8D) having rounded or square corners, or a teardrop shape as shown for disc 146 of extender 147 (see FIG. 10). The invention is not limited to the size of the disc and, in one non-limiting embodiment of the invention but not limited thereto, the area of the disc is greater than the available touch plate surface area of the key. Non-limiting embodiments of discs according to the invention used with extenders for a piano keyboard include the circular-shaped disc 42 having a diameter of greater than 1 inch, for example and not limiting to the invention, 1.38 inches and 2 inches; the elliptical-shaped disc 140 having a major axis greater than 1 inch, for example and not limiting to the invention, having a length of 2 inches and a minor axis having a length of greater than 0.75 inch, for example and not limiting to the invention, 1 inch; the rectangular disc 142 having a length greater than 1 inch, for example and not limiting to the invention, 2 inches, and having a width greater than 0.5 inch, for example and not limiting to the invention, 0.75 inch and 1 inch; and the teardrop disc 146 having a circular body having a diameter of greater than 1 inch, for example and not limiting to the invention, 1.75 inches. The discs can all have the same shape or different shape to accommodate the discs at a position spaced from the keyboard. For example and not limiting to the invention, every other octave of the piano keyboard can have a disc of one shape, for example and not limiting to the invention, the teardrop-shaped disc 146 and the adjacent octave can have a disc of a different shape, for example and not limiting to the invention, the rectangular-shaped disc 142 or the circular discs 42 shown in FIG. 1. The discs of the invention can be made of any material and are preferably made of a rigid or structurally-stable material, e.g., wood, metal, glass, plastic, or reinforced fiberglass, such that contact surface 150 of the disc substantially maintains its flatness after repeated depressions. The disc can be joined to an end of the elongated rod in any convenient manner. With reference to FIG. 11, in one non-limiting embodiment of the invention, the disc 42 has a threaded hole 151 to receive threaded end 152 of elongated rod 154. With reference to FIG. 10, in a further non-limiting embodiment of the invention, elongated rod 36 of the extender 147 has a loop-shaped end 158. A metal sheet 160 overlays the looped end 158, and ends 162 of the metal sheet 160 are wrapped around the looped end 158. With reference to FIG. 8A, in a still further non-limiting embodiment of the invention, the rod 36 has a curled end 170, with the curled end 170 secured to the disc 42 by a layer of adhesive or solder (not shown) of the type used in the art. Further, the end portion of the elongated rod can be attached to the disc using any of the techniques discussed above to attach the end portion 40 of the elongated rod 36 to the attachment member. As can be appreciated, the invention is not limited to the manner in which the end portion of the elongated rod is joined to the key of a key board, e.g., a piano keyboard 22 shown in FIG. 9. More particularly and with reference to FIG. 11, the elongated rod 154 has end 174 bent to have a serpentine shape. One part 176 of a multi-part fastener 178, for example but not limiting to the invention, half of a Velcro® fastener, is secured to the serpentine end 174 and the another part 180 of the fastener 178, for example and not limiting to the invention, the other half of the Velcro® fastener, is secured to a key, e.g., the white piano key 26. The parts 176 and 180 of the fastener 178 can be joined to their respective one of the rod end 174 or key 26 in any conventional manner, for example and not limiting to the invention, by an adhesive, for example and not limiting to the invention, of the type sold under the trademark Super Glue.

In the practice of the invention, several extenders 30 were made and used to depress the keys of a piano having flanges 32. The disc of the extender was a 2½ inch plastic cover from a tobacco can. A loop was formed in an end portion of a portion of a coat hanger wire, and a blind rivet passed through the center portion of the disc and the loop to secure the end portion of the coat hanger to the disc. The opposite end portion of the coat hanger was secured to a lever of a binder clip, by solder or by bending a loop in the wire, mounting a washer on the lever of the binder clip, and passing a rivet through the loop lever and washer. Further, the extender 147 shown in FIG. 10 was made and included one half of a Velcro® fastener secured to curled end 184 by an adhesive. Still further, an extender was made having the disc 42 joined to the curled end 170 of the elongated rod 36 by an adhesive layer (not shown) (see FIG. 8A) and having one half of a Velcro® fastener joined to the serpentine end 174 of the rod 154 by an adhesive (see FIG. 11).

In the practice of the invention, having the contact area of the contact member, e.g., disc, greater than the available touch plate surface area of the key and/or having the spaced distance between adjacent discs of extenders mounted on adjacent keys of a keyboard spaced a greater distance than the spaced distance between the adjacent keys of the keyboard, allows a disabled person to depress a piano key by depressing the disc, thereby avoiding depressing or contacting adjacent piano keys. The contact surface of the discs can be colored for ease of identifying the note of the key, or can have a design to make the discs aesthetically pleasing. Further, as can now be appreciated, the invention is not limited to the arrangement of discs of extenders mounted on keys of a keyboard, e.g. and not limiting to the invention, the dics can be arranged in a circular pattern as shown in FIG. 1 or in an offset pattern as shown in FIG. 9, e.g., a vertical or horizontal offset pattern.

Figure 12:
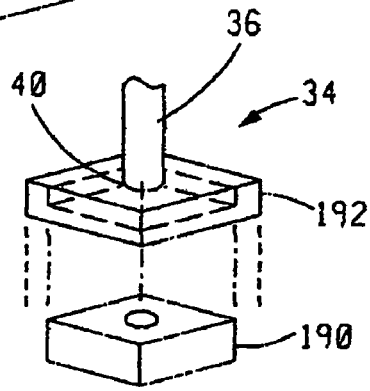
FIG. 12 is an orthogonal view of a key of a typewriter keyboard, computer keyboard, calculator keyboard, or a telephone keyboard and an attachment clip to secure the extender to the key.

With reference to FIG. 12, there is shown a key 190 of a computer keyboard, typewriter, telephone, or calculator. Attachment member 34 is a rigid cover 194 that fits over the key 190 and is attached to the end portion 40 of the elongated rod 36. The internal surface of the cover may have a tacky material to secure the cover on the key 190.

As can now be appreciated, the invention is not limited to the above non-limited embodiments of the invention and other embodiments within the scope of the function and cooperation of the elements can be assembled. Further, as can be appreciated, the particular embodiments described in detail herein are illustrative only and are not limiting to the scope of the invention, which is to be given the full breadth of the appended claims and any and all equivalents thereof.

The invention claimed is:

1. An extender for a key of a keyboard, comprising:

an elongated member having a first end portion secured to a contact member, and an opposite second end portion having one part of a fastening arrangement and the key having another part of the fastening arrangement, wherein with the second end portion fastened to the key, displacing the contact member in a predetermined direction displaces the key in the predetermined direction, and wherein the key has a touch plate area and the contact member has a contact area greater than the touch plate area of the key, and further wherein the second end portion of the elongated member has a series of circular bends and the first part of the fastener is one part of a Velcro® fastener secured to the series of circular bends.

2. The extender according to claim 1, wherein the keyboard is selected from at least one of the following: a musical instrument keyboard, a computer keyboard, a calculator keyboard, a typewriter keyboard, a machine console keyboard, and a telephone keyboard.

3. The extender according to claim 2, wherein the keyboard is a piano keyboard.

4. The extender according to claim 1, wherein the first end portion of the elongated member has a loop shape and the contact member is a bendable sheet, the sheet overlaying a surface of the loop, with ends of the sheet engaging the loop to secure the sheet to the first end portion of the elongated member.

5. The extender according to claim 1, wherein the first end portion of the elongated member has one or more circular bends, with the circular bends secured to the contact member by a fastener selected from one of the following: adhesives, flowed molten metal or metal alloy.

6. The extender according to claim 1, wherein the first end portion of the elongated member has one or more circular bends, with the circular bends secured to the contact member by a two-part fastener, and wherein one part of the fastener is secured to the first end portion of the elongated member and the other part of the fastener is secured to the contact member.

7. The extender according to claim 1, wherein the elongated member is an elongated rod having a yield strength in the range of 10,000 to 50,000 pounds per square inch.

8. The extender according to claim 1, wherein the contact member has a shape selected from the group of a circular shape, an elliptical shape, a rectangular shape having rounded corners, a rectangular shape having square corners, a square shape having rounded corners, a square shape having square corners, a teardrop shape, and combinations thereof.

9. The extender according to claim 1, wherein the elongated member is a manually-deformable, elongated metal rod.

10. The extender according to claim 1, wherein the contact member and the one part of the fastening member are detachably secured to their respective end portion of the elongated member.

11. The extender according to claim 10, wherein the one part is one part of a Velcro® fastener.

12. The extender according to claim 1, wherein the keyboard is a piano keyboard and the key is one of a plurality of piano keys, and at least one of the piano keys has the elongated member secured thereto defined as the attached piano key, and wherein displacing the contact member in a downward direction displaces the attached piano key in the downward direction.

13. An extender for a key of a keyboard, comprising:

an elongated member having a first end portion secured to a contact member, and an opposite second end portion having one part of a fastening arrangement and the key having another part of the fastening arrangement, wherein with the second end portion fastened to the key, displacing the contact member in a predetermined direction displaces the key in the predetermined direction, and wherein the key has a touch plate area and the contact member has a contact area greater than the touch plate area of the key, and further wherein the second end portion of the elongated member has a serpentine shape and the first part of the fastener is one part of a Velcro® secured to the serpentine shaped second end portion of the elongated member.

* * * * *